US012507858B2

(12) United States Patent
Hu et al.

(10) Patent No.: US 12,507,858 B2
(45) Date of Patent: Dec. 30, 2025

(54) PRESSURE SENSING ASSEMBLY FOR A DISHWASHER APPLIANCE

(71) Applicant: Haier US Appliance Solutions, Inc., Wilmington, DE (US)

(72) Inventors: Haitian Hu, Louisville, KY (US); Adam Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 78 days.

(21) Appl. No.: 18/584,562

(22) Filed: Feb. 22, 2024

(65) Prior Publication Data

US 2025/0268448 A1 Aug. 28, 2025

(51) Int. Cl.
*A47L 15/42* (2006.01)
*A47L 15/00* (2006.01)

(52) U.S. Cl.
CPC ..... *A47L 15/4244* (2013.01); *A47L 15/0023* (2013.01); *A47L 15/0028* (2013.01); *A47L 15/0049* (2013.01); *A47L 15/0063* (2013.01); *A47L 15/4217* (2013.01); *A47L 15/4219* (2013.01); *A47L 15/4293* (2013.01); *A47L 2401/09* (2013.01); *A47L 2401/32* (2013.01); *A47L 2501/01* (2013.01); *A47L 2501/03* (2013.01); *A47L 2501/26* (2013.01)

(58) Field of Classification Search
CPC ..... A47L 15/0023; A47L 15/0028; A47L 15/0049; A47L 15/0063; A47L 15/4217; A47L 15/4219; A47L 15/4244; A47L 15/4293; A47L 2401/09; A47L 2401/32; A47L 2501/01; A47L 2501/03; A47L 2501/26
See application file for complete search history.

(56) References Cited

U.S. PATENT DOCUMENTS

| | | | | |
|---|---|---|---|---|
| 6,772,094 | B2 | 8/2004 | Tyson | |
| 10,371,568 | B2 | 8/2019 | Shin et al. | |
| 2021/0244257 | A1* | 8/2021 | Alhaffar | A47L 15/0023 |
| 2021/0277564 | A1* | 9/2021 | Mashal | D06F 33/34 |
| 2022/0049895 | A1 | 2/2022 | Oh et al. | |

FOREIGN PATENT DOCUMENTS

| | | | | |
|---|---|---|---|---|
| CN | 103120576 | B | 9/2015 | |
| KR | 960015411 | B1 | 11/1996 | |
| KR | 20140014744 | A * | 2/2014 | A47L 15/46 |

OTHER PUBLICATIONS

KR20140014744A machine translation (Year: 2014).*

* cited by examiner

*Primary Examiner* — Douglas Lee
(74) *Attorney, Agent, or Firm* — Dority & Manning, P.A.

(57) ABSTRACT

A dishwasher appliance includes a wash tub and a sump for collecting wash fluid, a pump assembly for selectively urging a flow of the wash fluid from the sump, a pressure sensor for monitoring a wash fluid level within the wash tub, a microphone for monitoring sound generated during operation of the dishwasher appliance, and a controller configured to obtain a pressure reading using the pressure sensor, determine that the wash fluid in the sump is at a low level based at least in part on the pressure reading, energize the pump assembly to circulate the wash fluid, obtain a sound signal generated during energization of the pump assembly using the microphone, determine that the wash fluid in the sump is not at a low level based at least in part on the sound signal, and provide a user notification that the pressure sensor is defective.

20 Claims, 4 Drawing Sheets

PRESSURE SENSING ASSEMBLY FOR A DISHWASHER APPLIANCE

FIELD OF THE INVENTION

The present subject matter relates generally to dishwasher appliances, and more particularly, to systems and methods for monitoring water levels in a dishwasher appliance.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Certain conventional dishwasher appliances include pressure sensors to help determine the amount of water in the dishwasher. Notably, when water is filled in a dishwasher and a lower-than-normal reading is reported by the pressure sensor, the cause for the low reading may be due to a faulty pressure sensor or there may be an issue with the water filling process, such as low inlet water pressure. For example, a unit with a clogged pressure sensor generates a lower than expected water level after the completion of the fill, but the deviation from the intended range could have been caused by a malfunctioning water valve, low inlet water pressure, or any other problem unrelated to the clogged pressure sensor. Lack of knowledge as to the source of the low reading may result in incorrect diagnostics, improper maintenance, and consumer dissatisfaction.

Accordingly, a dishwasher appliance with an improved means for detecting the cause of low pressure readings is desired. More specifically, a dishwasher appliance that can identify a defective pressure sensor would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dishwasher appliance defining a vertical direction, a lateral direction, and a transverse direction is provided. The dishwasher appliance includes a wash tub that defines a wash chamber and a sump for collecting wash fluid, a pump assembly for selectively urging a flow of the wash fluid from the sump, a pressure sensor for monitoring a wash fluid level within the wash tub, a microphone for monitoring sound generated during operation of the dishwasher appliance, and a controller in operative communication with the pump assembly and the microphone. The controller is configured to obtain a pressure reading using the pressure sensor, determine that the wash fluid in the sump is at a low level based at least in part on the pressure reading, energize the pump assembly to circulate the wash fluid, obtain a sound signal generated during energization of the pump assembly using the microphone, determine that the wash fluid in the sump is not at a low level based at least in part on the sound signal, and provide a user notification that the pressure sensor is defective.

In another exemplary embodiment, a method of operating a dishwasher appliance is provided. The dishwasher appliance includes a pump assembly for selectively urging a flow of wash fluid from a sump, a pressure sensor for monitoring a wash fluid level within a wash tub, and a microphone for monitoring sound generated during operation of the dishwasher appliance. The method includes obtaining a pressure reading using the pressure sensor, determining that the wash fluid in the sump is at a low level based at least in part on the pressure reading, energizing the pump assembly to circulate the wash fluid, obtaining a sound signal generated during energization of the pump assembly using the microphone, determining that the wash fluid in the sump is not at a low level based at least in part on the sound signal, and providing a user notification that the pressure sensor is defective.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
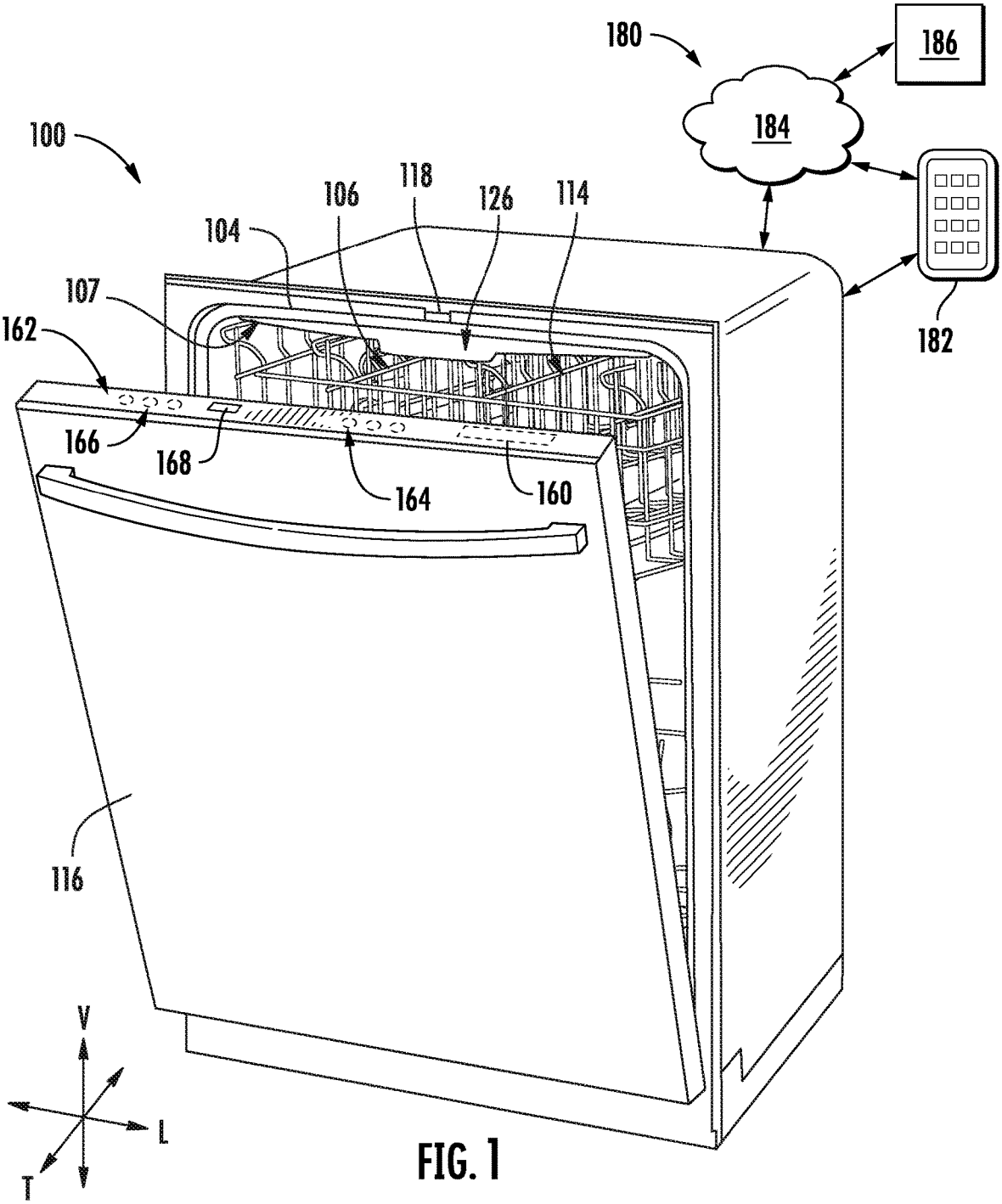
FIG. 1 provides a perspective view of a dishwasher appliance, including a dishwasher door according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
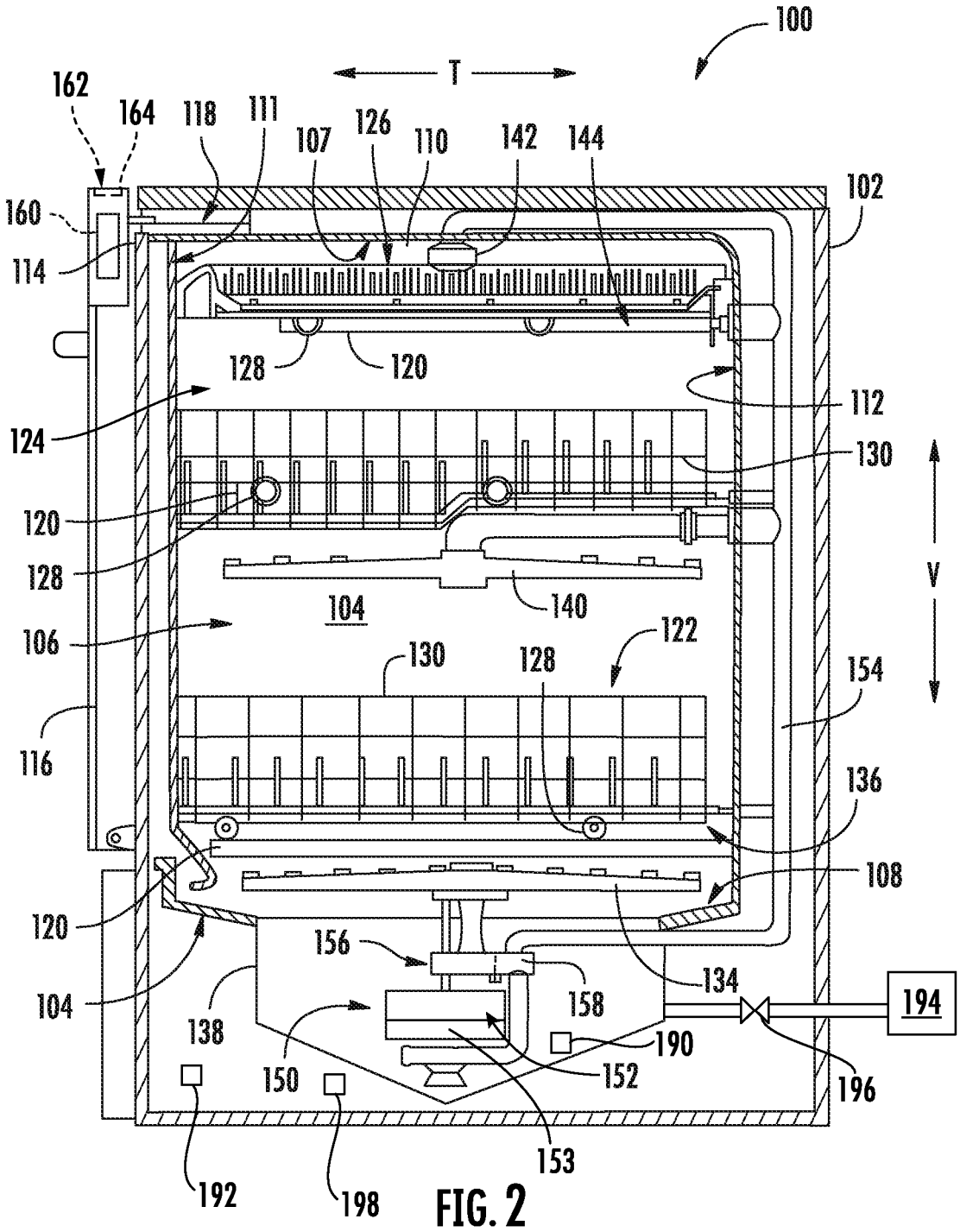
FIG. 2 provides a cross-sectional side view of the exemplary dishwashing appliance of FIG. 1 according to an example embodiment of the present disclosure.

FIGS. 1 and 2 depict an exemplary domestic dishwashing appliance or dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump assembly 152 for circulating water or wash fluid (e.g., detergent, water, or rinse aid) in the tub 104. For example, pump assembly 152 may include a pump motor that drives pump assembly 152 to circulate or discharge wash fluid. Pump assembly 152 may be located within sump 138 or within a machinery compartment located below sump 138 of tub 104, as generally recognized in the art. Fluid circulation assembly 150 may include one or more fluid conduits or circulation piping for directing water or wash fluid from pump assembly 152 to the various spray assemblies and manifolds. For example, as illustrated in FIG. 2, a primary supply conduit 154 may extend from pump assembly 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump assembly 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump assembly 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump assembly 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 may be in operative communication with a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electromechanical input devices including capacitive touch screens/buttons, rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 1 and 2, door 116 will be described according to exemplary embodiments of the present subject matter. Although door 116 is described herein as being used with dishwasher 100, it should be appreciated that door 116 or variations thereof may be used on any other suitable residential or commercial appliance. As described herein, door 116 may share a coordinate system with dishwasher 100, e.g., when door 116 is in the closed position (e.g., as shown in FIG. 2). Specifically, door 116 may define a vertical direction V, a lateral direction L, and a transverse direction T. Therefore, these directions may be used herein to refer to features of door 116 and its various components and sub-assemblies.

As shown, in the normally closed position, door 116 extends from a top end or top edge to a bottom end or bottom edge along the vertical direction V; from a front end to a rear end along the transverse direction T; and between two lateral ends along the lateral direction L. According to exemplary embodiments, door 116 may be formed from one or more exterior panels that define an interior chamber of door 116. According to exemplary embodiments, the exterior panels of door 116 may be panels that are stamped from stainless steel or may be formed from any other suitably rigid material, such as thermoformed plastic, other metals, etc. In general, the exterior panels of door 116 may be assembled in any suitable manner, e.g., may be secured together using any suitable mechanical fastener, welding, snap-fit mechanisms, etc. In addition, it should be appreciated that an insulating material (not shown), such as fiberglass or foam insulation, may be positioned within door 116 to provide thermal and/or sound insulation to dishwasher 100.

Referring still to FIGS. 1 and 2, user interface panel 164 is positioned proximate the top edge of door 116 along the vertical direction V. In this manner, user interface panel 164 may be partially hidden below a countertop when dishwasher appliance 100 is installed below the countertop and door 116 is closed. Accordingly, dishwasher appliance 100 may be referred to as a "top control dishwasher appliance." However, it should be appreciated that aspects of the present subject matter may be used with dishwasher appliances having other configurations or any other suitable appliance. For example, user interface panel 164 may be alternately positioned on front face or front end of door 116.

User interface panel 164 is positioned on door 116 such that a user can engage or interact with user interface panel 164, e.g., to select operating cycles and parameters, activate/deactivate operating cycles, or adjust other operating parameters of dishwasher appliance 100. User interface panel 164 may include a printed circuit board (not shown) that is positioned within door 116. According to exemplary embodiments, printed circuit board may include or be operatively coupled to controller 160 and/or user interface panel 164. In addition, user interface panel 164 may include or be operably coupled to one or more user inputs or touch buttons (e.g., identified generally herein as user inputs 166) for receiving user input, providing user notifications, or illuminating to indicate cycle or operating status.

Specifically, according to the illustrated embodiment, user inputs 166 include a plurality of capacitive sensors that are mounted to user interface panel 164 and are operable to detect user inputs. For example, these capacitive sensors may be configured for triggering when a user touches the top edge of user interface panel 164 in a region associated with a particular user input 166. In particular, these capacitive sensors can detect when a finger or another conductive material with a dielectric different than air contacts or approaches user interface panel 164, along with the precise location, pressure, etc. of the finger interaction.

When a user touches the top edge of user interface panel 164 adjacent one of user inputs 166, the associated capacitive sensors may be triggered and may communicate a corresponding signal to controller 160. In such a manner, operations of dishwasher appliance 100 can be initiated and controlled. According to exemplary embodiments, the capacitive sensors may be distributed laterally on user interface panel 164. It will be understood that other any suitable number, type, and position of capacitive sensors may be used while remaining within the scope of the present subject matter. Indeed, any suitable number, type, and configuration of user inputs 166 may be used while remaining within the scope of the present subject matter. User interface panel 164 may define a plurality of surfaces that are intended to be illuminated for various purposes. For example, user inputs 166 may be illuminated by light sources to inform the user of the location of the button or to provide some other status indication. Notably, this illumination is typically achieved by directing a light beam along the vertical direction V onto the top edge of user interface panel 164. Door 116 may further include a plurality of light sources or lighting devices that are configured for illuminating one or more surfaces of user interface panel 164. It should be appreciated that these light sources may include any suitable number, type, configuration, and orientation of light sources mounted at any suitable location to illuminate status indicators or buttons in any suitable colors, sizes, patterns, etc. In other words, the light sources may be provided as any suitable number, type, position, and configuration of electrical light source(s), using any suitable light technology and illuminating in any suitable color. For example, the light sources may include one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, the light sources may include any other suitable traditional light bulbs or sources, such as halogen bulbs, fluorescent bulbs, incandescent bulbs, glow bars, a fiber light source, etc. Moreover, the light sources may be operably coupled (e.g., electrically coupled) to controller 160 or another suitable control board to facilitate activation or illumination of the light sources (e.g., to indicate a user input, state of the dishwasher appliance, state of the wash cycle, or any other relevant information to a user).

According to exemplary embodiments, user interface panel 164 may be any suitable transparent or semitransparent feature for diffusing, directing, or otherwise transmitting light from a light source. For example, user interface panel 164 may be formed from a suitable transparent or translucent material configured to direct light energy, such as a dielectric material, such as glass or plastic, polycarbonate, polypropylene, polyacrylic, or any other suitable material.

In addition, user interface panel 164 may be a dead fronted panel. As used herein, the term "dead front" and the like is generally intended to refer to portions of a control panel which may be used as indicators, buttons, interactive control surfaces, or other user-interaction features without exposing the user to the operating side of the equipment or live parts and connections, i.e., lights, electrical connections, etc. For example, user interface panel 164 may include a transparent or translucent body and an opaque masking material that is selectively printed on the top edge of the translucent body to define capacitive touch buttons or user inputs 166.

The opaque material may be deposited on the translucent body to define any suitable number, size, and configuration of illuminated features. These illuminated features may be shapes or include other forms such as symbols, words, etc. that are visible on user interface panel 164. More specifically, when light sources are energized, capacitive touch buttons or user inputs 166 on the top edge may be illuminated. Thus, the dead fronted the top edge may be the surface that is contacted for controlling dishwasher appliance 100 or which may be illuminated for purposes of indicating operating status or other conditions to the user of the dishwasher appliance 100.

Referring still to FIG. 1, a schematic diagram of an external communication system 180 will be described according to an exemplary embodiment of the present subject matter. In general, external communication system 180 is configured for permitting interaction, data transfer, and other communications between dishwasher appliance 100 and one or more external devices. For example, this communication may be used to provide and receive operating parameters, user instructions or notifications, performance characteristics, user preferences, or any other suitable information for improved performance of dishwasher appliance 100. In addition, it should be appreciated that external communication system 180 may be used to transfer data or other information to improve performance of one or more external devices or appliances and/or improve user interaction with such devices.

For example, external communication system 180 permits controller 160 of dishwasher appliance 100 to communicate with a separate device external to dishwasher appliance 100, referred to generally herein as an external device 182. As described in more detail below, these communications may be facilitated using a wired or wireless connection, such as via a network 184. In general, external device 182 may be any suitable device separate from dishwasher appliance 100 that is configured to provide and/or receive communications, information, data, or commands from a user. In this regard, external device 182 may be, for example, a personal phone, a smartphone, a tablet, a laptop or personal computer, a wearable device, a smart home system, or another mobile or remote device.

In addition, a remote server 186 may be in communication with dishwasher appliance 100 and/or external device 182 through network 184. In this regard, for example, remote server 186 may be a cloud-based server 186, and is thus located at a distant location, such as in a separate state, country, etc. According to an exemplary embodiment, external device 182 may communicate with a remote server 186 over network 184, such as the Internet, to transmit/receive data or information, provide user inputs, receive user notifications or instructions, interact with or control dishwasher appliance 100, etc. In addition, external device 182 and remote server 186 may communicate with dishwasher appliance 100 to communicate similar information.

In general, communication between dishwasher appliance 100, external device 182, remote server 186, and/or other user devices or appliances may be carried using any type of wired or wireless connection and using any suitable type of communication network, non-limiting examples of which are provided below. For example, external device 182 may be in direct or indirect communication with dishwasher appliance 100 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 180 is described herein according to an exemplary embodiment of the present subject matter. However, it should be appreciated that the exemplary functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

As noted briefly above, pressure sensors may be used in dishwashers to help determine the amount of water in the dishwasher. Accordingly, as illustrated, dishwasher appliance 100 includes a pressure sensor 190 operably coupled to sump 138 for measuring a pressure of wash fluid within sump 138, e.g., to facilitate wash fluid level detection. In general, pressure sensor 190 may be any sensor suitable for determining a water level within sump 138 based on pressure readings. For example, pressure sensor 190 may be a piezoelectric pressure sensor and thus may include an elastically deformable plate and a piezoresistor mounted on the elastically deformable plate. However, it should be appreciated that according to alternative embodiments, pressure sensor 190 may be any type of pressure sensor that is fluidly coupled to sump 138 in any other suitable manner for obtaining sump pressures to facilitate water level detection.

Notably, when water is filled in a dishwasher and a lower-than-normal reading is reported by the pressure sensor, the cause for the low reading may be due to a faulty pressure sensor or there may be an issue with the water filling process, such as low inlet water pressure. For example, a unit with a clogged pressure sensor may generate a lower than expected water level after the completion of the fill, but the deviation from the intended range could have been caused by a malfunctioning water valve, low inlet water pressure, or any other problem unrelated to the clogged pressure sensor. Lack of knowledge as to the source of the low reading may result in incorrect diagnostics, improper maintenance, and consumer dissatisfaction.

Accordingly, as explained in more detail below, dishwasher appliance 100 may utilize a microphone to help diagnose a faulty pressure sensor or other operational issues with dishwasher appliance 100. Specifically, dishwasher appliance 100 may include a microphone 192 that is positioned at any suitable location within the vicinity of dishwasher appliance 100 for monitoring sound generated by dishwasher appliance 100. For example, according to the illustrated embodiment, microphone 192 may be positioned within or proximate to sump 138. In general, microphone 192 may be used for monitoring the sound waves, noises, or other vibrations generated during the operation of dishwasher appliance 100. For example, microphone 192 may be one or more microphones, acoustic detection devices, vibration sensors, or any other suitable acoustic transducers that are positioned at one or more locations in or around dishwasher appliance 100.

As best shown in FIG. 2, dishwasher appliance 100 may further include a water supply 194 that is generally configured for dispensing a flow of water into wash tub 104 to facilitate appliance operation. For example, water supply 194 generally includes a spout that is fluidly coupled to sump 138 and is configured for directing a flow of fluid into wash tub 104. In addition, a water supply valve 196 may regulate the flow of water from water supply 194 (such as a municipal water supply) into wash tub 104. It should be appreciated that water supply 194 and water supply valve 194 may be positioned at any other suitable location within cabinet 102. Other systems and methods for supplying water are possible and within the scope of the present subject matter.

Now that the construction of dishwasher appliance 100 according to exemplary embodiments have been presented, an exemplary method 200 of operating a dishwasher appliance will be described. Although the discussion below refers to the exemplary method 200 of operating dishwasher appliance 100, one skilled in the art will appreciate that the exemplary method 200 is applicable to the operation of a variety of other dishwasher appliances and motors on any other suitable appliance.

In exemplary embodiments, the various method steps as disclosed herein may be performed by controller 160 or a separate, dedicated controller. In this regard, as described herein, controller 160 of dishwasher appliance 100 may implement all steps of method 200. However, it should be appreciated that according to alternative embodiments, controller 160 may offload the analysis described herein, e.g., by sending pressure readings and sound signals to remote server 186 for analysis. Other distributed analysis arrangements are possible and within the scope of the present subject matter.

Figure 3:
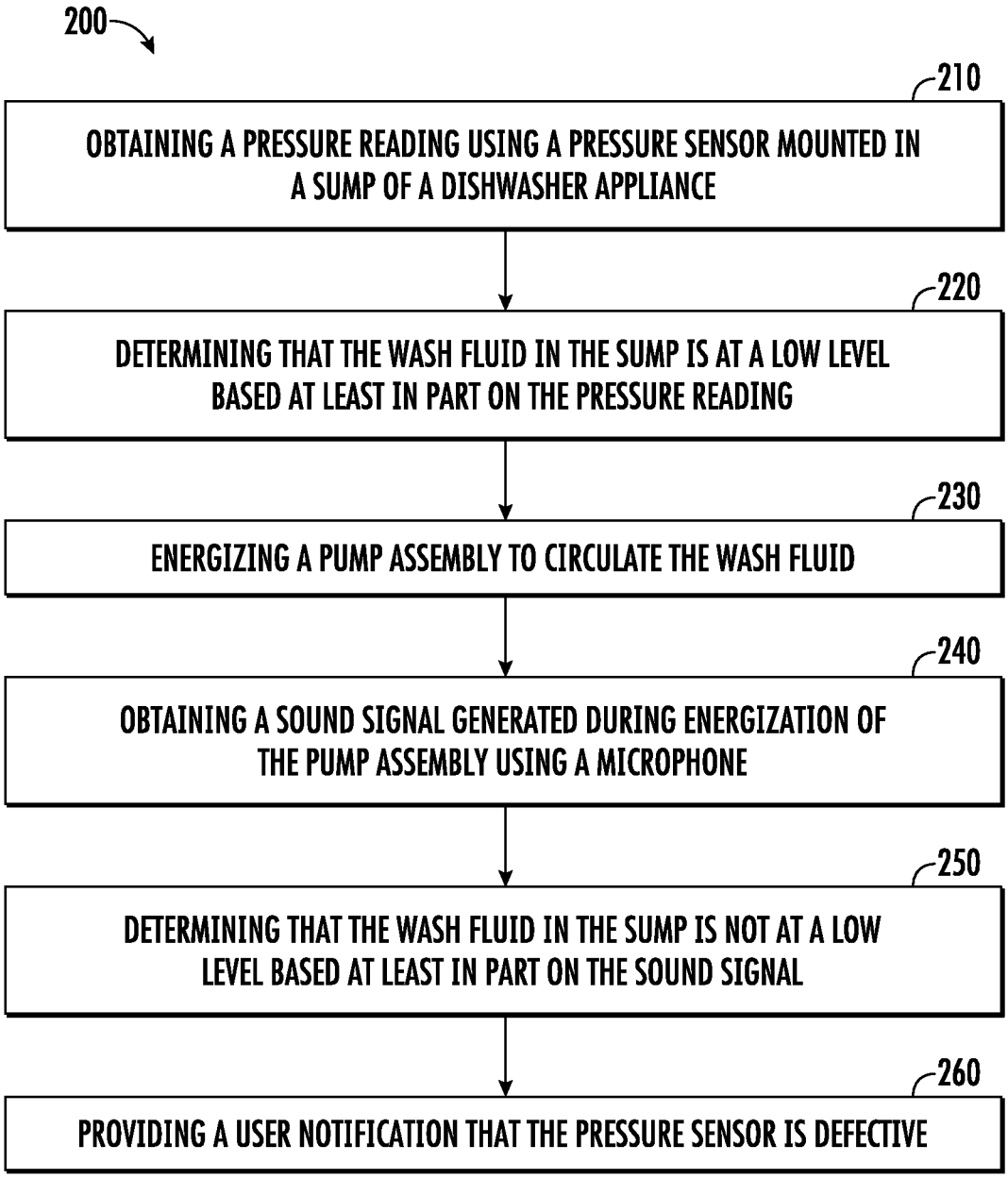
FIG. 3 illustrates a method for operating a dishwasher appliance in accordance with one embodiment of the present disclosure.

Referring now to FIG. 3, method 200 includes, at step 210, obtaining a pressure reading using a pressure sensor mounted in a sump of a dishwasher appliance. In this regard, continuing the example from above, pressure sensor 190 may be used to periodically or continuously monitor the water pressure and water level within wash tub 104. According to example embodiments, method 200 may further include operating water supply 194 and water supply valve 196 to perform a fill cycle to add water into wash tub 104. In this regard, water supply valve 196 may be open for a predetermined amount of time to dispense a target volume of water for a specific wash cycle of dishwasher appliance 100. According to example embodiments, the pressure reading obtained at step 210 may be obtained after completion of the fill cycle, e.g., when the target volume of water is presumably within wash tub 104.

Step 220 may include determining that the wash fluid in the sump is at a low level based at least in part on the pressure reading. In this regard, controller 160 may be programmed with a predetermined pressure range or threshold that is associated with a properly filled wash tub. If the pressure sensor indicates that the sump pressure is below that target threshold or outside the target range, controller 160 may determine that the wash fluid in sump 138 is low. As noted above, if pressure sensor 190 is faulty, there may be sufficient water in wash tub 104 and it may be undesirable to implement a responsive action based on the erroneous pressure reading. By contrast, if pressure sensor 190 is not faulty, the water level may be low due to a variety of other factors, such as low water pressure, a faulty water supply valve 196, etc.

Accordingly, method 200 may further include steps for verifying the reading of pressure sensor 190 and for diagnosing other operational issues with dishwasher appliance 100. For example, step 230 may include energizing a pump assembly to circulate the water or wash fluid within wash tub 104. In this regard, continuing the example from above, after completion of the fill cycle, controller 160 may operate pump assembly 152 with the intention of circulation wash water, discharging wash water, etc. Notably, the sound generated by operation of pump assembly 152 may vary depending on whether there is a sufficient or target volume of wash fluid within sump 138. For example, operation of pump assembly 152 may be relatively quiet if the target volume of wash fluid is being circulated, whereas the volume may increase substantially when there is a low level of wash fluid within sump 132, e.g., due to air being sucked into pump assembly 152.

Therefore, it may be desirable to monitor the sound generated by pump assembly 152. Thus, step 240 may generally include obtaining a sound signal generated during energization of the pump assembly using a microphone mounted in the sump or at another suitable location on the dishwasher appliance. In this regard, during and immediately after energizing pump assembly 152, controller 160 may use microphone 192 to monitor sounds or noises generated within and around dishwasher appliance 100. By monitoring the sound generated, controller 160 may identify issues with pump assembly, water supply 194, water supply valve 196, and/or pressure sensor 190.

In general, the analysis of the sound signal may be made based on the amplitude of sound (e.g., in decibels) falling within or outside of predetermined ranges, thresholds, etc. In addition, or alternatively, method 200 may include identifying unique sound signatures or audio profiles within the sound signal. These sound signatures may be associated with specific events, such as the sucking of air into pump assembly 152. It should be appreciated that the analysis of the sound signal may be performed locally by controller 160 or remotely, e.g., on remote server 186. Other methods of sound analysis are possible and within the scope of the present subject matter.

Step 250 may generally include determining that the wash fluid in the sump is not at a low level based at least in part on the sound signal. In this regard, if the sound signal generated by operating pump assembly 152 falls within the normal operating range or does not exceed a predetermined sound threshold, this may indicate that the amount of wash fluid within sump 138 is sufficient, e.g., the water level exceeds the low level detected by pressure sensor 190. Accordingly, this may be indicative of a situation where the pressure sensor is defective or faulty, e.g., as indicated by the conflicting determinations made using the two sensors.

Accordingly, step 260 may include providing a user notification that the pressure sensor is defective. This user notification may be communicated to the user in any suitable manner. For example, the user notification may be provided through a user interface panel (such as user interface panel 164), e.g., by illuminating a faulty sensor light indicator. According to still other embodiments, the user notification regarding the pressure sensor failure may be communicated directly to the user through external device 182 (e.g., such as the user's cell phone) via network 184. According to still other embodiments, the user notification may be provided to a smart speaker, to another connected appliance, or any other suitable device. In addition, according to example embodiments, method 200 may include communicating with a service technician, scheduling a maintenance service, ordering a new pressure sensor or part, etc.

According to still other embodiments, method 200 may include steps for determining that the water supply or water supply valves are defective. In this regard, method 200 may include determining that the wash fluid in the sump is at a low level based on the pressure reading and confirming that the wash fluid in the sump is at the low level based on the sound signal. Because analysis of these two singles both indicate that the water level is low, this may be indicative of a faulty water supply valve 196, a low water pressure of the water supply 194, a tub leak, or other operational issues with dishwasher appliance 100. Accordingly, method 200 may include providing a user notification or taking other corrective action to address these issues.

Figure 4:
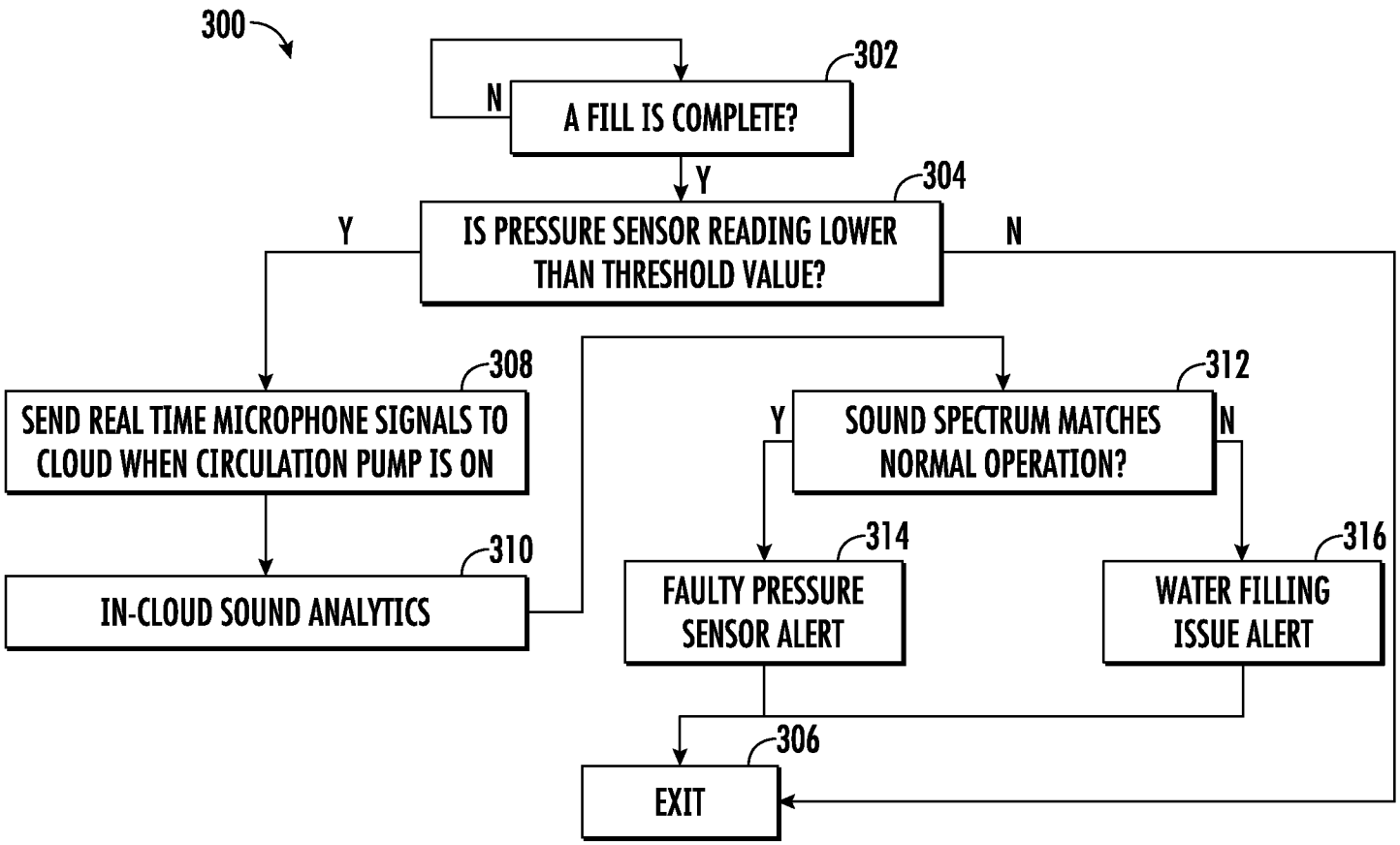
FIG. 4 provides a method of detecting a faulty pressure sensor in a dishwasher appliance according to an example embodiment of the present subject matter.

Referring now briefly to FIG. 4, a method 300 for detecting a faulty pressure sensor or a water filling issue will be described according to an example embodiment of the present subject matter. It should be appreciated that some or all of the steps of method 300 may be the same or similar to steps of method 200, and like reference numerals may be used to refer to the same or similar steps herein. Specifically, step 302 may include determining whether the fill cycle has been completed. This would indicate that a target volume of water is in sump 138 if dishwasher appliance 100 and water supply 194 are operating correctly. If the fill cycle is complete, step 304 may include determining that pressure sensor 190 senses that the water level is below a predetermined low water level threshold.

If the pressure reading is acceptable, step 306 ends method 300, otherwise, step 308 includes monitoring the sound of a circulation pump and sending the sound signal to the cloud for analysis. Step 310 includes the performance of in-cloud analytics and step 312 includes determining whether the sound signal matches normal operation of the pump assembly. If the sound signal is normal or expected, this may indicate a faulty pressure sensor at step 314. Alternatively, if the sound signal indicates that the water level is low (e.g., thus matching the pressure reading), this may indicate a water filling issue at step 316.

FIGS. 3 and 4 depict exemplary control methods having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the dishwasher appliance 100 as an example, it should be appreciated that these methods may be applied to other dishwasher appliance, or other appliances such as washing machine appliances.

As explained above, aspects of the present subject matter are generally directed to a cloud-based dishwasher with a self-diagnostic feature for detecting a faulty pressure sensor. The self-diagnostic feature may utilize an innovative algorithm that integrates circulation pump's sound analytics with pressure sensor's readings after a fill cycle to determine if there is a defective pressure sensor or a water filling issue. The algorithm may determine the sound difference between normal operation and low water operation when the dishwasher runs without sufficient water; where the circulation pump pushes the available water to spray arms resulting in a loud noise caused by the water/air mixture within the pump due to the air drawn before the water has a chance to return to the pump inlet. The occurrence of this loud noise may correspond to a specific threshold value unique to each dishwasher model, which serves as a target parameter for the algorithm. The algorithm may determine the root cause of low-pressure sensor reading after a fill designed to detect a lower-than-normal reading on the dishwasher's pressure sensor after the fill cycle. To verify the proper priming of the circulation pump, the algorithm may utilize a sound reading generated when the pump is activated by employing a microphone to distinguish between the sounds associated with normal operation and those indicative of low water operation. When the pressure sensor registers a low reading while the sound reading indicates an abnormal operation, this may indicate a problem with the water filling process. Consequently, an alert may be promptly sent to the user, notifying them of the water filling issue. Conversely, if the pressure sensor indicates low pressure and the sound reading indicates a normal operation, this may suggest a malfunctioning pressure sensor. In such cases, an alert notifying the user of the faulty pressure sensor may be generated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a wash tub that defines a wash chamber and a sump for collecting wash fluid;

a pump assembly for selectively urging a flow of the wash fluid from the sump;

a pressure sensor for monitoring a wash fluid level within the wash tub;

a microphone for monitoring sound generated during operation of the dishwasher appliance; and a controller in operative communication with the pump assembly and the microphone, the controller being configured to:

obtain a pressure reading using the pressure sensor;

determine that the wash fluid in the sump is at a low level based at least in part on the pressure reading;

energize the pump assembly to circulate the wash fluid;

obtain a sound signal generated during energization of the pump assembly using the microphone;

determine that the wash fluid in the sump is not at a low level based at least in part on the sound signal; and provide a user notification that the pressure sensor is defective.

2. The dishwasher appliance of claim 1, further comprising a water supply for selectively adding the wash fluid into the wash tub, wherein the controller is further configured to operate the water supply to perform a fill cycle to add the wash fluid into the wash tub, wherein the pressure reading and the sound signal are obtained after completion of the fill cycle.

3. The dishwasher appliance of claim 2, wherein the controller is further configured to:

determine that the wash fluid in the sump is at a low level based at least in part on the pressure reading;

confirm that the wash fluid in the sump is at the low level based at least in part on the sound signal; and provide a user notification that the water supply is defective.

4. The dishwasher appliance of claim 1, wherein confirming that the wash fluid in the sump is at the low level based at least in part on the sound signal comprises:

analyzing the sound signal to detect a low level sound signature associated with a low fill level.

5. The dishwasher appliance of claim 4, wherein the low level sound signature is associated with air being drawn into the pump assembly.

6. The dishwasher appliance of claim 1, wherein confirming that the wash fluid in the sump is at the low level based at least in part on the sound signal comprises:

determining that an amplitude of the sound signal exceeds predetermined decibel threshold.

7. The dishwasher appliance of claim 1, wherein determining that the wash fluid in the sump is at the low level based at least in part on the pressure reading comprises:

determining that the pressure reading is below a predetermined threshold value after completion of a fill cycle.

8. The dishwasher appliance of claim 1, wherein the microphone is a piezoelectric microphone.

9. The dishwasher appliance of claim 1, wherein the pressure sensor and the microphone are positioned within the sump of the dishwasher appliance.

10. The dishwasher appliance of claim 1, wherein the controller is configured to:

transmit the sound signal to a remote server for analysis.

11. The dishwasher appliance of claim 1, wherein the user notification is provided through a user interface panel.

12. The dishwasher appliance of claim 1, wherein the controller is in operative communication with a remote device through an external network, and wherein the user notification is provided through the remote device.

13. The dishwasher appliance of claim 12, wherein the remote device comprises at least one of a mobile phone or a smart speaker.

14. A method of operating a dishwasher appliance, the dishwasher appliance comprising a pump assembly for selectively urging a flow of wash fluid from a sump, a pressure sensor for monitoring a wash fluid level within a wash tub, and a microphone for monitoring sound generated during operation of the dishwasher appliance, the method comprising:

obtaining a pressure reading using the pressure sensor;

determining that the wash fluid in the sump is at a low level based at least in part on the pressure reading;

energizing the pump assembly to circulate the wash fluid;

obtaining a sound signal generated during energization of the pump assembly using the microphone;

determining that the wash fluid in the sump is not at a low level based at least in part on the sound signal; and providing a user notification that the pressure sensor is defective.

15. The method of claim 14, wherein the dishwasher appliance further comprises a water supply for selectively adding the wash fluid into the wash tub and the method further comprises operating the water supply to perform a fill cycle to add the wash fluid into the wash tub, wherein the pressure reading and the sound signal are obtained after completion of the fill cycle.

16. The method of claim 15, further comprising:

determining that the wash fluid in the sump is at a low level based at least in part on the pressure reading;

confirming that the wash fluid in the sump is at the low level based at least in part on the sound signal; and providing a user notification that the water supply is defective.

17. The method of claim 14, wherein confirming that the wash fluid in the sump is at the low level based at least in part on the sound signal comprises:

analyzing the sound signal to detect a low level sound signature associated with a low fill level.

18. The method of claim 17, wherein the low level sound signature is associated with air being drawn into the pump assembly.

19. The method of claim 14, wherein confirming that the wash fluid in the sump is at the low level based at least in part on the sound signal comprises:

determining that an amplitude of the sound signal exceeds predetermined decibel threshold.

20. The method of claim 14, wherein determining that the wash fluid in the sump is at the low level based at least in part on the pressure reading comprises:

determining that the pressure reading is below a predetermined threshold value after completion of a fill cycle.

* * * * *